US005127255A

United States Patent [19]

Skotek

[11] Patent Number: 5,127,255

[45] Date of Patent: Jul. 7, 1992

[54] FRAMES AND RAMS FOR TERMINAL APPLICATORS

[75] Inventor: David A. Skotek, Harrisburg, Pa.

[73] Assignee: AMP Incorporated, Harrisburg, Pa.

[21] Appl. No.: 722,635

[22] Filed: Jun. 27, 1991

[51] Int. Cl.[5] ..... B21D 43/02; B21D 43/04

[52] U.S. Cl. ..... 72/421; 72/428; 72/456

[58] Field of Search ..... 72/421, 428, 456; 29/417, 753, 759

[56] References Cited

U.S. PATENT DOCUMENTS

| | | | |
|---|---|---|---|
| 3,004,581 | 10/1961 | Krol et al. | 29/753 |
| 3,101,765 | 8/1963 | Batcheller | 29/753 |
| 3,184,950 | 5/1965 | Sitz | 29/753 |
| 3,343,398 | 9/1967 | Kerns | 72/421 |
| 3,496,626 | 2/1970 | Ullman et al. | 29/753 |
| 3,763,555 | 10/1973 | Van de Kerkhof | 29/628 |
| 3,766,625 | 10/1973 | Wagner | 29/203 |
| 3,911,717 | 10/1975 | Yuda | 29/753 |
| 4,019,362 | 4/1977 | McKeever | 72/421 |
| 4,025,999 | 5/1977 | Wolyn et al. | 29/753 |
| 4,114,253 | 9/1978 | Loomis et al. | 29/566.2 |
| 4,959,988 | 10/1990 | Dassance et al. | 72/421 |

*Primary Examiner*—Robert L. Spruill
*Assistant Examiner*—Donald M. Gurley

[57] ABSTRACT

A frame and ram for terminal applicators is described which can be used for applicators for ladder strip terminals and can be used for applicators for in-line strip terminals. The frame has first and second mounting sites for strip feeders, the first mounting site being used when a ladder strip applicator is being produced. The second mounting site is used for the feeding mechanism for an applicator for in-line strip. The applicator ram has first and second slots or grooves therein in which racks can be mounted. A rack is mounted in the first groove for cooperation with the strip feeder for a ladder strip and a rack is mounted in the second groove or channel for cooperation with a strip feeder for in-line strip.

12 Claims, 6 Drawing Sheets 56
58'
54
32
52
60
58
38'
42'
40'
46'
34
44
28
46
38
30
42
40
36
84
88
80
74
86
72
90
82
70
76
78
64
26
67
68
79
62
68
66
79

FRAMES AND RAMS FOR TERMINAL APPLICATORS

FIELD OF THE INVENTION

This invention relates to terminal applicators and particularly the frames and rams for terminal applicators which can be used for applicators for ladder strip terminals and for applicators for in-line strip terminals.

CROSS-REFERENCES TO ISSUED PUBLICATIONS

U.S. Pat. Nos. 3,184,950 and 3,343,398 are incorporated into this description by reference.

BACKGROUND OF THE INVENTION

A widely used type of crimping apparatus for electrical terminals comprises a conventional press and a terminal applicator. The applicator has an applicator frame, which is mounted on the press platen, and an applicator ram which is coupled to the press ram. The applicator also has a strip feeding mechanism for feeding terminal strip to a crimping zone which contains fixed and movable crimping tooling.

Terminal strip is provided in two general types; terminals in ladder strip form comprises terminals in side-by-side parallel relationship with each terminal being integral with a continuous carrier strip that extends for the length of the strip. Terminals are also manufactured in the form of in-line strip in which the contact portion of each terminal in the strip is connected to the crimp portion of the next adjacent terminal. Different types of applicators are required for the two types and in general, applicators for ladder strip terminals have few parts which are interchangeable with applicators for in-line strip. A manufacturer of applicators must therefore produce a large number of different parts if he is to offer a complete line of applicators for all types of terminal strip.

The present invention is directed to the achievement of a press or applicator frame and ram which can be used in applicators for ladder strip terminals and can be used for applicators for in-line strip terminals.

THE INVENTION

The invention comprises a frame and a reciprocable ram for a terminal applicator. The complete applicator has a crimping zone, a feed track for guiding a terminal strip to the crimping zone, strip feeding means for feeding the strip towards the crimping zone, and fixed and movable crimping tooling on the ram and on the frame. The frame and ram are usable in applicators for ladder strip, in which the terminals are in side-by-side parallel relationship, and can be used for applicators for in-line strip in which the terminals are connected end to end. The frame and ram are characterized in that the frame comprises a ram housing, a base portion, and a connecting neck which extends between the housing and the base portion. The ram housing has a passageway extending therethrough and the ram is slidably contained in the passageway. The crimping zone is proximate to the base portion and in alignment with the ram. First and second feeding means mounting sites are provided on the frame and first and second feed track mounting means are provided on the base portion. A first feed track, when mounted on the base portion, extends from the crimping zone in a first direction and is effective to guide ladder-type strip towards the crimping zone. A second feed track, when mounted on the base portion, extends from the crimping zone in a second direction and is effective to guide in-line strip towards the crimping zone. There is an included angle between the first and second feed tracks when mounted on the base portion and the neck is offset from the passageway and is within the included angle. An applicator for ladder strip is thus produced by mounting a first feeding means and a first feed track on the first mounting site and the first mounting means, respectively. An applicator for in-line strip is provided by mounting a second feeding means and a second feed track on the second mounting site and the second mounting means, respectively.

In the preferred embodiment, the ram has first and second actuating means mounting sites thereon proximate to the first and second feeding means mounting sites respectively. Each of the actuating means mounting sites is intended to receive an actuating means for a feeding means mounted on the associated feeding means mounting site. The actuating means mounting sites are preferably intended to have a rack mounted thereon for cooperation with a pinion.

THE DRAWING FIGURES

FIG. 3 is a frontal view of the applicator of FIG. 1.

THE DISCLOSED EMBODIMENT

Figure 1:
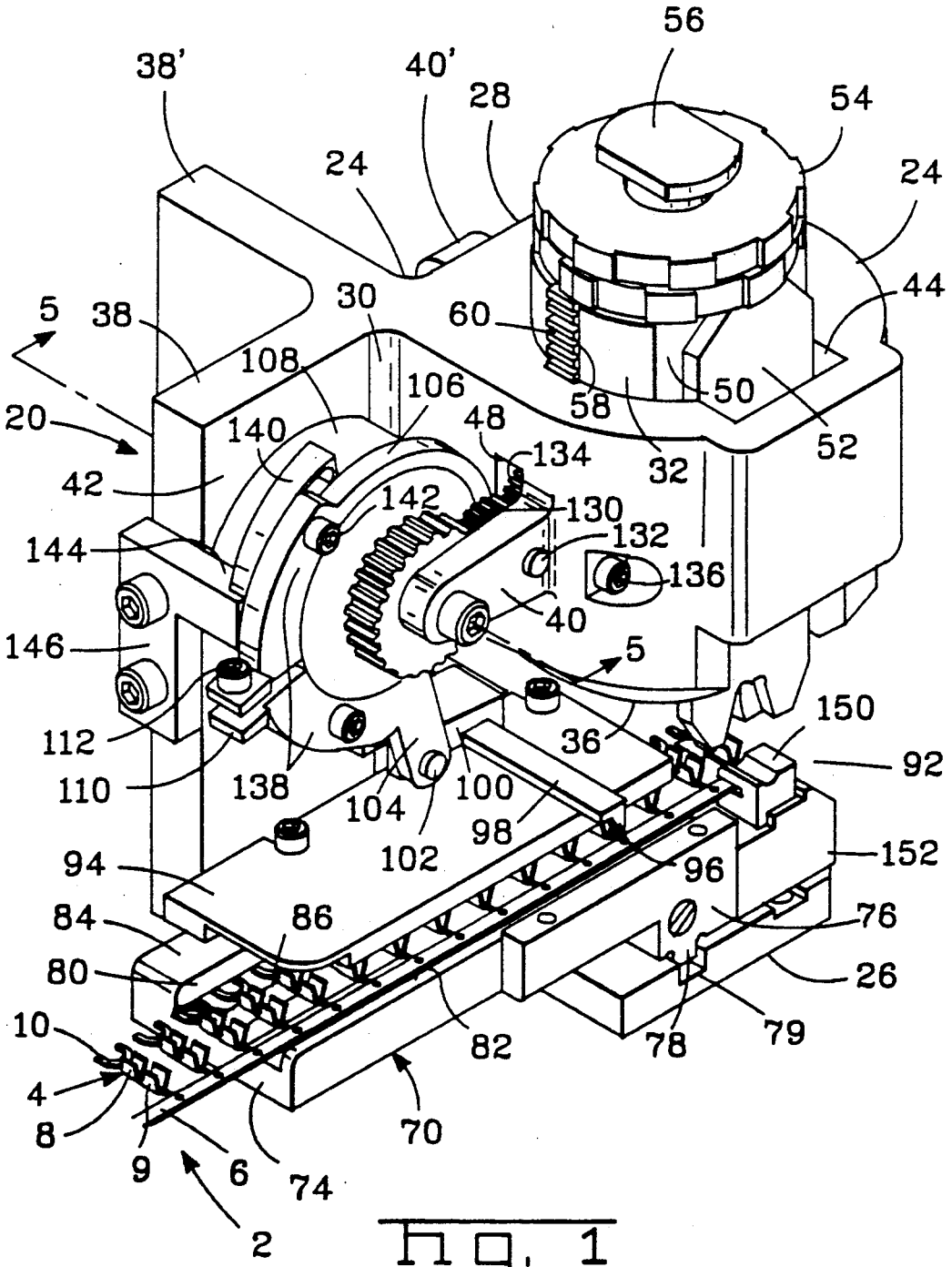
FIG. 1 is a perspective view of an applicator for terminals in ladder strip form in accordance with the invention.

FIG. 1 shows a section of ladder strip 2 comprising terminals 4 in side-by-side parallel relationship. Each terminal comprises crimp portions 8, 9 and a contact portion 10. The crimp portion 9 is intended for the insulation of a wire and is integral with a continuous carrier strip 6. The strip is fed to the crimping zone 92 of the applicator in the direction parallel to the carrier strip as shown in FIG. 1.

A typical section of in-line strip 12 comprises terminals 14, each of which has a contact portion and crimp portions. The leading end of the contact portion of each terminal is integral with the trailing end of the crimp portion of the next adjacent terminal. This type of strip is fed axially to present the leading terminal to the crimping zone of the applicator. FIG. 1 shows a side feed applicator 20 and an end feed type applicator is shown at 22, FIG. 6. The side feed applicator is described in detail below and the end feed applicator 22 will be described subsequently.

The side feed applicator 20 comprises a frame 24 which in turn is made up of a frame base 26, a ram housing 28, and a connecting neck section 30, 38, 38'. The connecting section comprises two arms 38, 38' which are integral with each other and with the ram housing as shown at 30. A ram receiving passageway 34 extends through the housing and has a lower end 36 which is spaced from the base portion of the frame.

A first ear 40 extends from the ram housing adjacent to the surface 42 of the arm 38 and a second ear 40' extends from the housing adjacent to, and spaced from, the surface 42' of the arm 38'. These ears define mounting sites for feed mechanisms as shown and as will be described in detail below.

The passageway 34 in the ram housing is enlarged as shown at 44 for reception of the movable crimping tooling 52 which is mounted on the ram. Grooves, or channels, 46, 46' are provided on the surface of the passageway and extend axially adjacent to the ears 40, 40' and adjacent to and past openings 48, 48'.

The ram 32 is generally cylindrical but has an axially extending flat surface 50 against which the movable crimping tooling 52 is mounted. On its upper end, rotatable dials 54 are provided for adjusting the positions of the crimping dies as explained in U.S. Pat. No. 3,343,398. The ram has a coupling 56 on its upper end to permit coupling to the ram of the press in which the applicator is mounted. First and second channels or grooves 58, 58' extend axially on the surface of the ram adjacent to the grooves or channels 46, 46' in the housing. In the embodiment of FIG. 1, a rack 60 is mounted in the channel 58 by a fastener.

The base 26 of the frame comprises a generally rectangular plate having opposite sides 62, 64 and having a laterally extending ear 66 projecting from its side 62. Three openings 68 are provided for fasteners which secure the base plate to the arms of the frame and to the section 30 of the neck portion. The base plate has a plurality of openings and slots as shown. Slots 79 receive the strip guides described below. The openings 67 are provided for the fixed crimping tooling and the fixed shear block 152.

The applicator 20 has a side feed strip guide 70 mounted above the base plate for guiding the terminal strip to the crimping zone. The strip guide is positioned on the base by means of a rib 78 on its underside which is received in a recess 79 in the base plate and secured by fasteners. The end 76 of the strip guide is located adjacent to the crimping zone 92 and the end 74 is spaced from the crimping zone as shown in FIG. 1. The strip material 2 is fed from a reel or other source past the end 74 and over the upper side of the strip guide. This upper side has a central recess 80 extending along the path of strip feed thereby to provide support surfaces 82, 84 on each side of the recess for the terminal strip. In addition, an adjustable central support 86 for the terminal strip is provided. This central supporting bar is adjustably secured to the plate by means of screws 90 and slots 88. The adjustability of this central supporting bar permits the strip guide to be used with different types of terminals. A confining cover 94 for the strip is secured to the arm 38 and extends from a location adjacent to the end 74 of strip guide 70 to the crimping zone 92.

Figure 2:
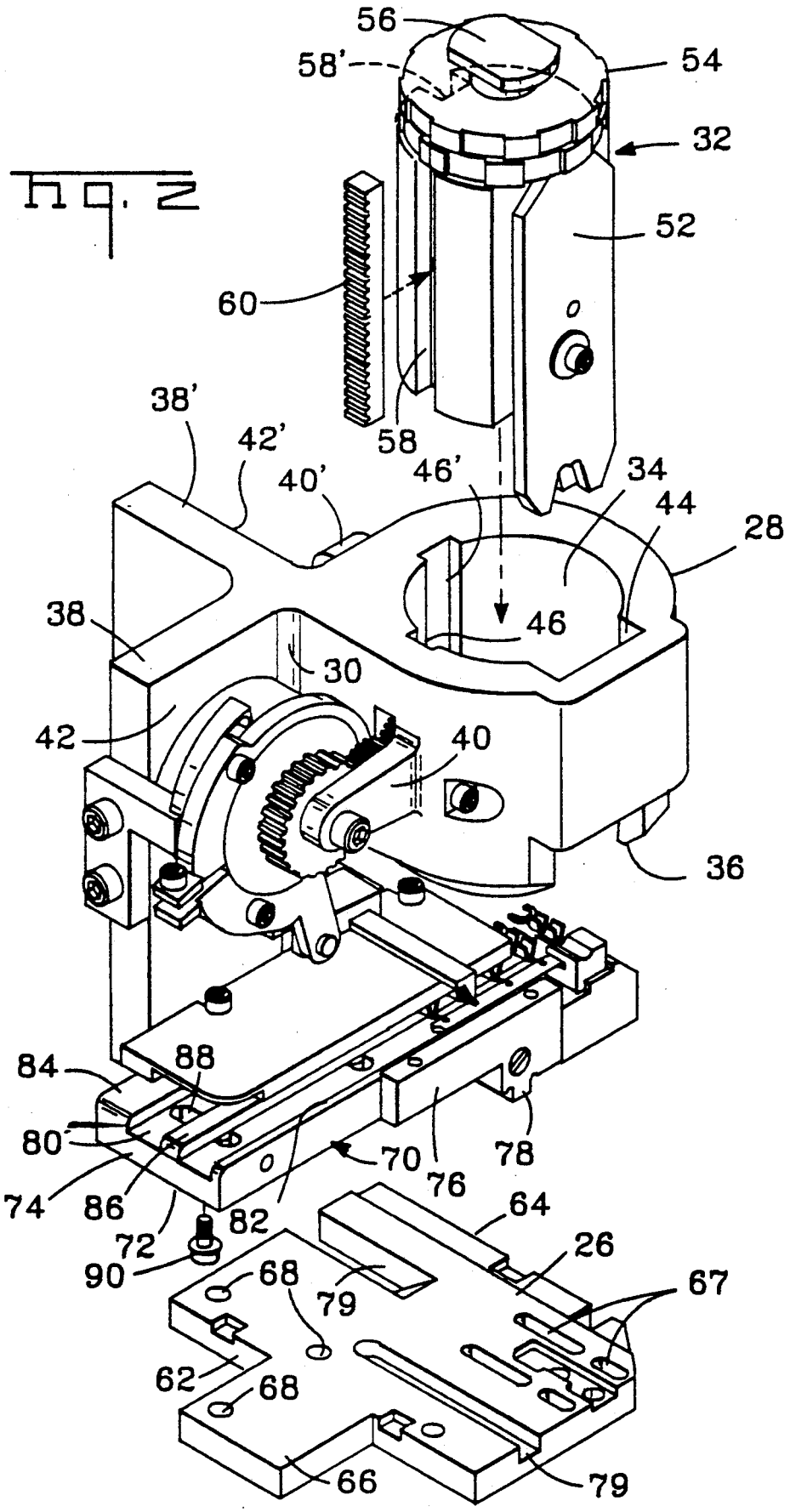
FIG. 2 is a view similar to FIG. 1 showing some of the parts exploded from each other.
Figure 1:
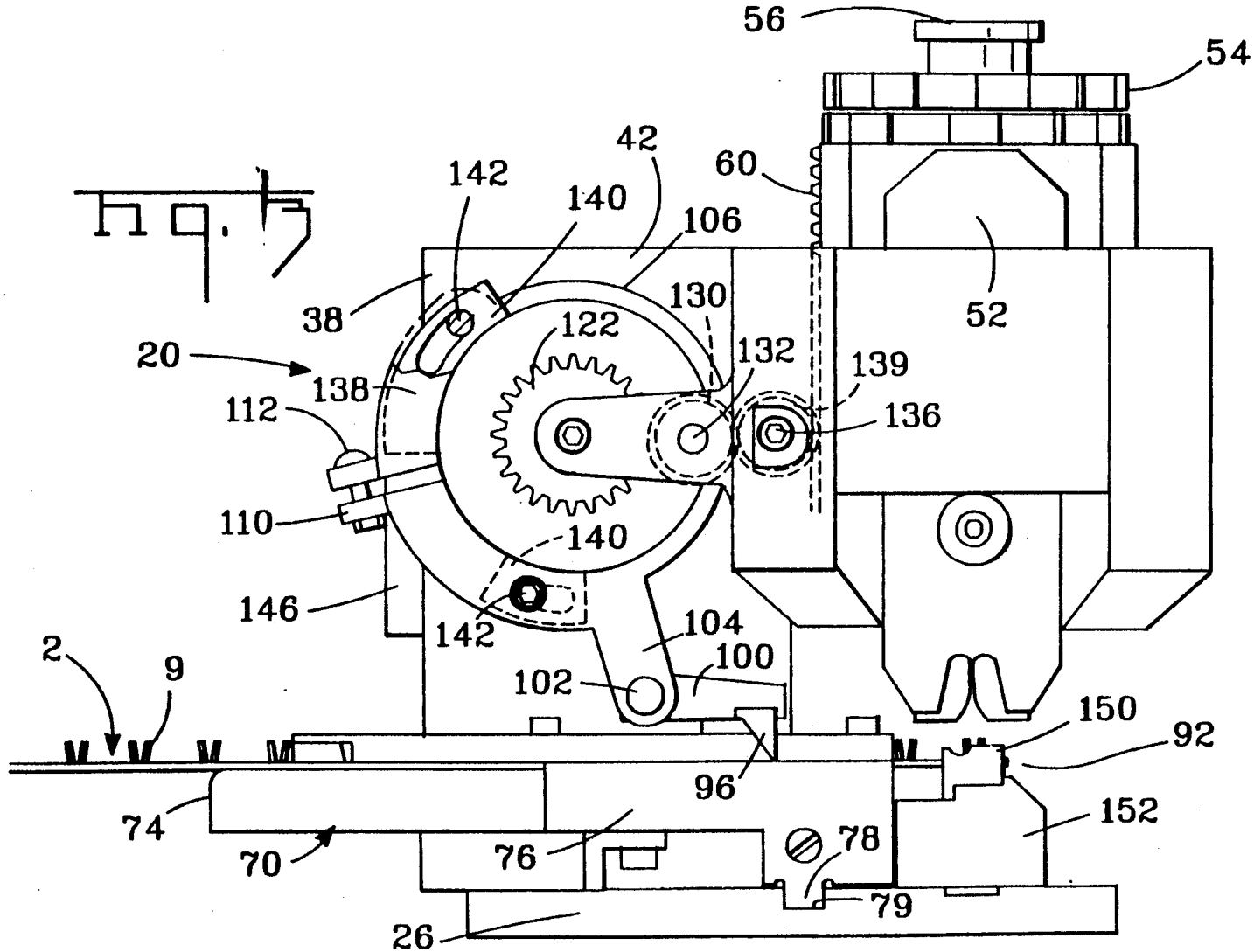
Figure 4:
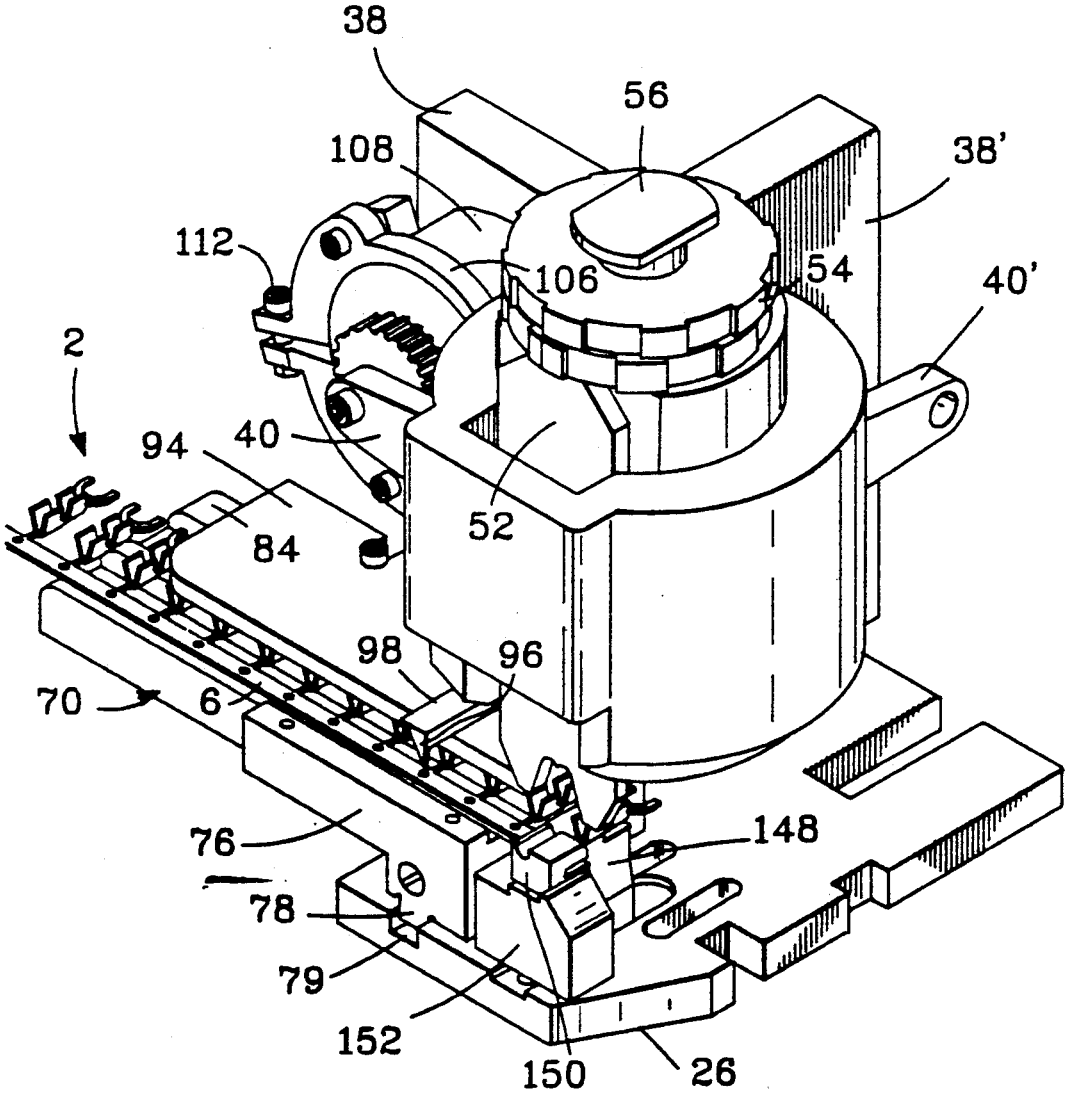
FIG. 4 is a perspective view from a vantage point 90 degrees to the right of FIG. 1.
Figure 5:
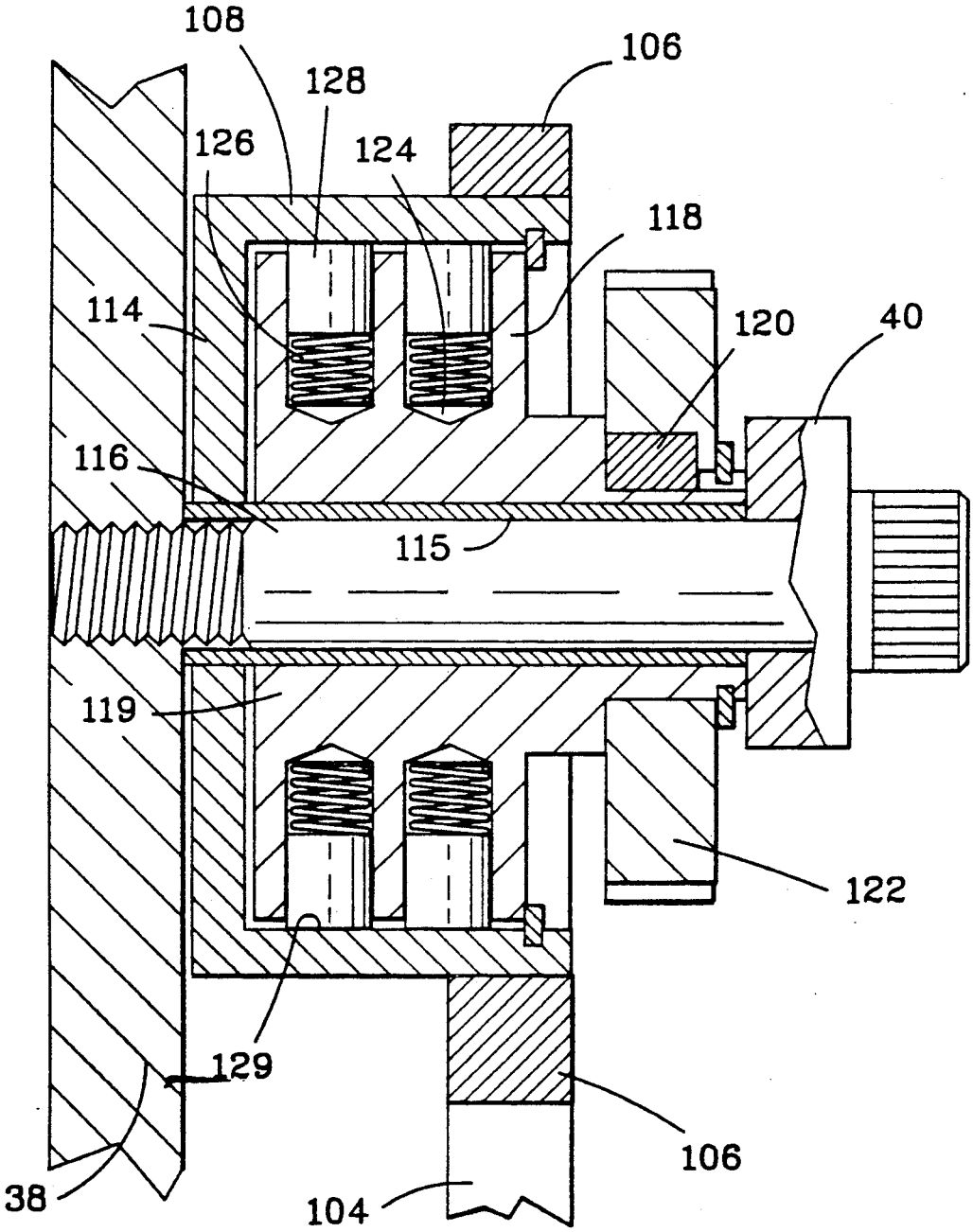
FIG. 5 is a view looking in the direction of the arrows 5—5 in FIG. 1.

The strip 2 is intermittently fed to the lower or fixed tooling 92 by means of a reciprocable feed pawl 96 which is on the end of an arm 98 that extends laterally from a block 100. The block is pivotally mounted on a pin 102 which extends between ears 104 that in turn extend from a collar 106. A torsion spring is provided (not specifically shown) for biasing the feed pawl and the block 100 in a clockwise direction, as viewed in FIGS. 1 and 2 so that the feed pawl can swing upwardly when it is retracted. The collar 106 is firmly clamped to the external surface of a hollow cylindrical housing 108, which serves as a pawl carrier, by means of ears 110 which extend from the adjacent ends of the split collar and a screw 112 which draws the ears towards each other. The housing 108 (FIG. 5) has an end wall 114, FIG. 5, which is supported for free rotation bearing 115 which is on a fixed pin or shaft 116 which is supported at its ends in the arm 38 and in the ear 40. The interior of the cylindrical housing 108 contains a coupling assembly 118 in the form of a cylindrical body having an extension 119 by means of which it is keyed at 120 to a gear 122. The cylindrical body is, in effect, an oscillatory shaft supported on fixed shaft 116. The coupling member 118 has a plurality of recesses 124 extending radially inwardly from its surface. Each recess contains a spring 126 and a bearing shoe 128 of graphite or similar material which is urged against the internal surface 129 of the cylindrical pawl carrier housing 108. The arrangement is such that the housing 108 is effectively coupled to the cylindrical coupling 118 so long as the torque applied to the coupling body 118 does not exceed a predetermined limit. If the limit is exceeded, the coupling body 118 will rotate independently of the housing 108. The gear 122, to which the coupling body 118 is keyed, is in mesh with an idler gear 130 that is supported for free rotation on a fixed pin or shaft 132 that extends from the ear 40. The idler gear, in turn, is in mesh with a pinion 134 supported on a shaft or pin 136 that extends through the ram housing. The pinion 134 is in mesh with the previously identified rack 60 on the ram.

When the ram moves downwardly from the position shown in FIG. 1, the gear 122 is rotated in a clockwise direction by the pinion and the idler gear. The collar is thus moved in a clockwise direction and the feed pawl is retracted. Upon subsequent upward movement of the ram, the feed pawl is moved rightwardly as viewed in FIG. 1 thereby to feed the strip material and position the leading terminal on the strip in the crimping zone.

It is necessary to be able to limit the stroke of the feed pawl each direction, that is, it is necessary to limit the feeding stroke and the retracting or retraction stroke. The stroke is limited by a fixed stop 144 extending from a mounting section 146 which is secured to the edge of the arm 38 of the frame. The fixed stop is engaged by movable stops 140 which are secured to the collar 106. The movable stops have slots therein and ar secured to the collar by fasteners 142. The stops 140 can be adjusted so as to cause the feed stroke or the retraction stroke to end at any desired time.

The crimping zone contains the fixed tooling which is mounted on the base plate by means of suitable recesses and fasteners. It is also necessary to dispose of the carrier strip as it is fed past the crimping zone and emerges from the applicator. To this end, a movable shearing block 150 is provided which is contained in a support block 152. The movable shearing block 150 has a slot through which the carrier strip is fed and the exit side of this slot cooperates with an edge on the fixed block to shear the carrier strip into short sections which fall from an inclined surface of the fixed shear block 152.

Figure 6:
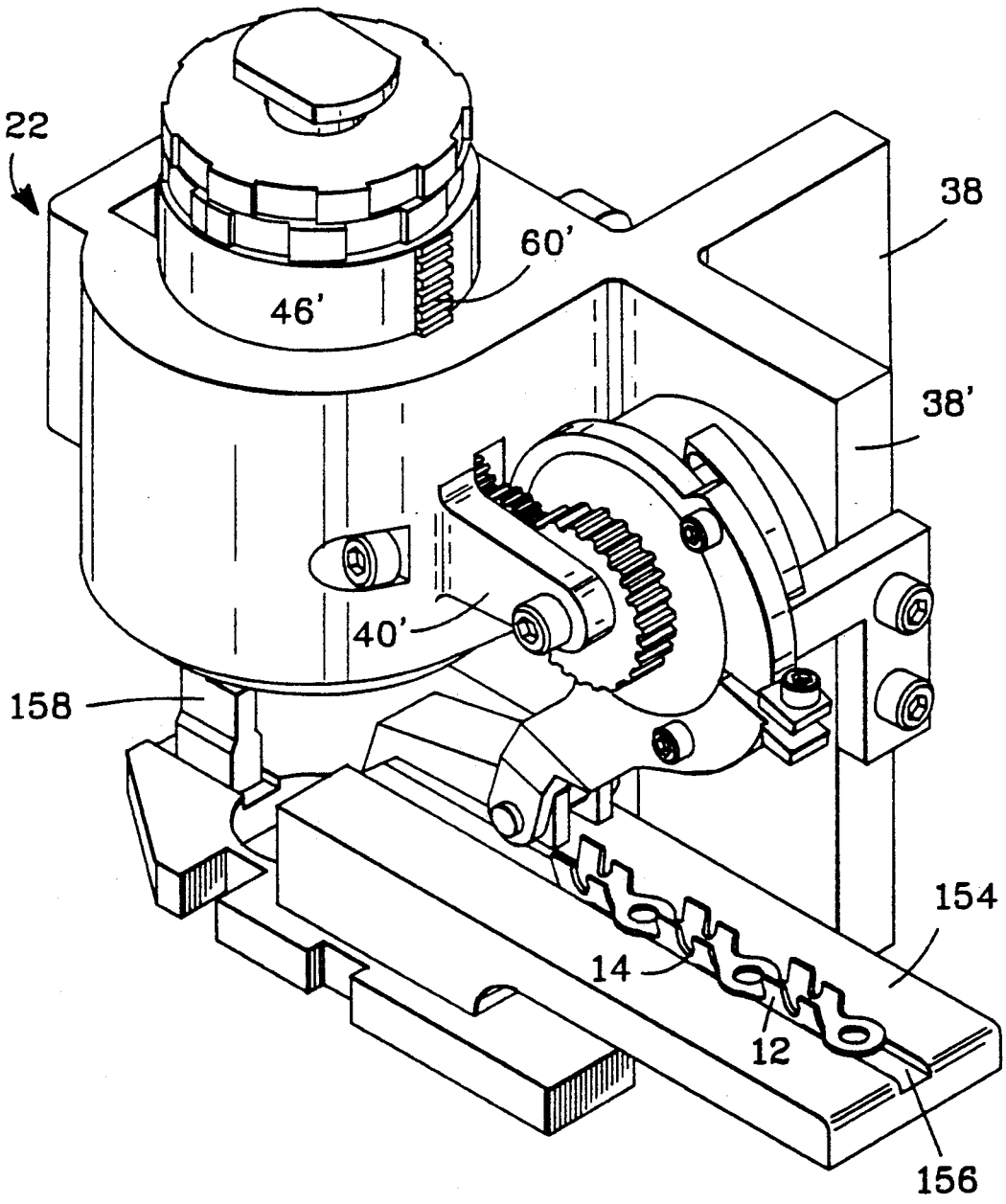
FIG. 6 is a perspective view of an applicator for in-line strip terminals.

An end feed applicator 22, FIG. 6, can be produced from the frame and ram assembly described above by simply mounting the strip feeding mechanism between the ear 40' and the arm 38'. The rack 60' is mounted on the ram in the groove 46' adjacent to the ear 40 for cooperation with a pinion and an idler gear as described above. The strip guide 154 for in-line strip has a channel 156 which guides the strip to the crimping zone so that the leading terminal of the strip is located on the fixed or lower tooling 158 in the crimping zone.

It will be apparent from the foregoing description that where a family or families of applicators must be provided to the users of terminals, the present invention can result a significant reduction in the number of individual parts which must be produced to provide applicators of all types. The applicator frame and the applicator ram, as described above, can be used in any side feed applicator which is required and can also be used in any end feed applicator. It merely remains, then, to provide a specific strip guide for the particular applicator which is required and to provide the specific fixed and movable tooling for the applicator.

I claim:

1. A frame for a terminal applicator, the applicator having a reciprocable ram, crimping tooling on the ram, a crimping zone, and a strip feeding means for feeding terminal strip to the crimping zone, the frame comprising:

a ram housing, a base portion, a first feeding means mounting site for reception of a first feeding means, a first feed track mounting means for reception of a first feed track, a second feeding means mounting site for reception of a second feeding means, and a second feed track mounting means for reception of a second feed track, the first and second feed track mounting means being on the base portion, the first feed track, when mounted on the first feed track mounting means, extending from the crimping zone in a first direction, the second feed track, when mounted on the second feed track mounting means, extending from the crimping zone in a second direction, the ram housing extending normally from the base portion and having a passageway therethrough for reception of the ram, the first feeding means and the first feed track, when mounted on the frame, being effective to feed a first type of terminal strip to the crimping zone, the second feeding means and the second feed track, when mounted on the frame, being effective to feed a second type of terminal strip tot he crimping zone whereby, the applicator frame can be used for applicators for the first type of terminal strip and can also be used for applicators for the second type of terminal strip.

2. A frame as set forth in claim 1 characterized in that the base portion is connected to the ram housing by a connecting neck, the neck being offset from the passageway and being between the positions occupied by the first and second feed tracks.

3. A frame and a reciprocable ram for a terminal applicator, the applicator having a crimping zone, feed track means for guiding a terminal strip to the crimping zone, and strip feeding means for feeding the terminal strip, and the frame and ram being characterized in that:

the frame comprises a ram housing an da base portion, the ram housing has a passageway extending therethrough, the ram being slidably contained in the passageway, the crimping zone being in alignment with the passageway, first and second feeding means mounting sites are provided for first and second strip feeding means, first and second feed track mounting means fare provided on the base portion for first and second feed tracks respectively, first and second actuating means mounting sites are provided on the ram proximate to the first and second feeding means mounting sites respectively, each of the actuating means mounting sites being intended to receive an actuating means for a feeding means mounted on the associated feeding means mounting site, the first feeding means and the first feed track, when mounted on the frame, being effective to feed ladder strip, comprising terminals in side-by side relationship, to the crimping zone, the second feeding means and the second feed track, when mounted on the frame, being effective to feed in-line strip, comprising terminals connected to each other end-to-end, to the crimping zone whereby, the applicator frame and ram can be used for applicators for ladder-type terminal strip and can be used for applicators for in-line terminal strip.

4. A frame and ram as set forth in claim 3 characterized in that the first and second feeding means mounting sites are on the ram housing.

5. A frame and ram as set forth in claim 4 characterized in that each of the actuating means mounting sites is intended to have a rack mounted thereon for cooperation with a pinion.

6. A frame and ram as set forth in claim 5 characterized in that the first feed track, when mounted on the first feed track mounting means, extends from the crimping zone in a first direction, the second feed track, when mounted on the second feed track mounting means, extends from the crimping zone in a second direction.

7. A frame and ram as set forth in claim 6 characterized in that the ram has an axis of reciprocation, the first and second feeding means mounting sites being angularly spaced apart at an angle of substantially 90 degrees with respect to the axis of reciprocation, the first feed track, when mounted on the frame, being proximate to the first feeding means mounting site, the second feed track, when mounted on the frame, being proximate to the second feeding means mounting site.

8. A frame and ram as set forth in claim 7 characterized in that the base portion is connected to the ram housing by a connecting neck which is offset from the passageway and is between the positions occupied by the first and second feed tracks.

9. A frame and a reciprocable ram for a terminal applicator, the applicatory having a crimping zone, a feed track for guiding a terminal strip to the crimping zone, strip feeding means for feeding the strip towards the crimping zone, and fixed and movable crimping tooling in the crimping zone and on the ram respectively, the frame and ram being usable in applicators for ladder strip, in which the terminals are in side-by-side parallel relationship, and being usable for applicators for in-line strip, in which the terminals are connected end-to-end, the frame and ram being characterized in that:

the frame comprises a ram housing, a base portion and a connecting neck which extends between the ram housing and the base portion, the ram housing having a passageway extending therethrough, the ram being slidably contained in the passageway, the crimping zone beign proximate to the base portion and in alignment with the ram, first and second feeding means mounting sites are provided on the frame and first and second feed track mounting means are provided on the base portion, a first feed track, when mounted on the base portion, extending from the crimping zone in a first direction and being effective to guide ladder strip towards the crimping zone, a second feed track, when mounted on the base portion, extending from the crimping zone in a second direction and being effective to guide in-line strip towards the crimping zone, there being an included angle between the first and second feed tracks when mounted on the base portion, and the neck is offset from the passageway and is within the included angle whereby, an applicator for ladder strip is provided by mounting a first feeding means and a first feed track on the first mounting site and the first mounting means, and an applicator for in-line strip is provided by mounting a second feeding means and a second feed track on the second mounting site and the second mounting means.

10. A frame and ram as set forth in claim 9 characterized in that the ram has first and second actuating means mounting sites thereon proximate to the first and second feeding means mounting sites respectively, each of the actuating means mounting sites being intended to receive an actuating means for a feeding means mounted on the associated feeding means mounting site.

11. A frame and ram as set forth in claim 10 characterized in that each of the actuating means mounting sites is intended to have a rack mounted thereon for cooperation with a pinion.

12. A ram housing for a terminal applicator which can be used for an applicator for ladder strip terminals and can be used for an applicator for in-line strip terminals, the ram housing being characterized in that:

the housing has a passageway extending therethrough for reception of an applicator ram, the housing therewith and extending past one of the ends of the passageway, the neck having an end portion which is spaced from the one end of the passageway, the neck comprising first and second ears which extend divergently from the housing, the ears beign angularly spaced apart by an angle of substantially 90 degrees, first and second mounting sites are provided on the first and second ears for reception of first and second strip feeders for terminals in ladder strip form and for terminals in in-line strip form respectively, first and second openings are provided in the housing proximate tot he first and second ears respectively, the openings communicating with the passageway, the openings being intended for the reception of first and second strip feeder actuating means coupled to the ram and extending through the passageway, and positioning and securing means are provided on the end portion of the connecting neck for precisely positioning an applicator base on, and securing the applicator base to, the connecting neck.

* * * * *